US008262430B2

(12) United States Patent
Ivanic et al.

(10) Patent No.: US 8,262,430 B2
(45) Date of Patent: Sep. 11, 2012

(54) ANIMAL SHAPED PUNCH TOY

(75) Inventors: Robert J. Ivanic, Saugus, CA (US); Christa S. Haratani, Torrance, CA (US)

(73) Assignee: Imperial Toy, LLC, Los Angeles, CA (US)

( * ) Notice: Subject to any disclaimer, the term of this patent is extended or adjusted under 35 U.S.C. 154(b) by 1051 days.

(21) Appl. No.: 11/491,430

(22) Filed: Jul. 21, 2006

(65) Prior Publication Data

US 2008/0020671 A1 Jan. 24, 2008

(51) Int. Cl.
*A63H 3/06* (2006.01)

(52) U.S. Cl. ..... 446/226; 446/220

(58) Field of Classification Search ..... 446/226
See application file for complete search history.

(56) References Cited

U.S. PATENT DOCUMENTS

| | | | | |
|---|---|---|---|---|
| 1,216,425 | A * | 2/1917 | Eiseman | 446/226 |
| 1,266,296 | A | 5/1918 | Mark | |
| 1,508,420 | A * | 9/1924 | Swartz et al. | 446/224 |
| 2,027,225 | A | 1/1936 | Gill | |
| 2,553,941 | A * | 5/1951 | Raab | 446/186 |
| 2,668,394 | A * | 2/1954 | Auzin | 446/183 |
| 2,685,758 | A * | 8/1954 | Ochs | 446/223 |
| 2,838,872 | A * | 6/1958 | Beck | 446/226 |
| 2,934,344 | A | 4/1960 | Chupa | |
| 4,132,032 | A * | 1/1979 | Triska | 446/132 |
| 4,770,412 | A * | 9/1988 | Wolfe | 482/85 |
| 5,033,498 | A | 7/1991 | Brandt | |
| 5,108,339 | A | 4/1992 | Kieves | |
| 5,451,179 | A | 9/1995 | LaRoi, Jr. et al. | |
| 5,522,757 | A * | 6/1996 | Ostrowski | 446/220 |
| 5,613,892 | A * | 3/1997 | Barton | 446/226 |
| 5,813,896 | A * | 9/1998 | Spector | 446/221 |
| 5,830,780 | A | 11/1998 | Dennison et al. | |
| 5,941,752 | A | 8/1999 | Liebermann | |
| 6,039,327 | A * | 3/2000 | Spector | 280/87.021 |
| 6,048,591 | A | 4/2000 | Zwiebel | |
| 6,331,131 | B1 | 12/2001 | Selevan | |
| 6,439,950 | B1 * | 8/2002 | Goldman et al. | 446/220 |
| 6,540,578 | B1 * | 4/2003 | Billon | 446/220 |
| 6,672,932 | B1 * | 1/2004 | Panec et al. | 446/185 |
| 6,773,330 | B1 * | 8/2004 | Cohen | 446/486 |
| 7,384,324 | B2 * | 6/2008 | Fullmer | 446/267 |
| 2004/0116039 | A1 * | 6/2004 | Mueller et al. | 446/220 |
| 2005/0233676 | A1 * | 10/2005 | Bohart | 446/313 |
| 2007/0077855 | A1 * | 4/2007 | Ivanic et al. | 446/183 |

FOREIGN PATENT DOCUMENTS

| | | |
|---|---|---|
| FR | 2713504 | 6/1995 |
| FR | 2713504 A3 * | 6/1995 |

OTHER PUBLICATIONS

PCT Search Report for PCT Appln No. PCT/US2007/016479, mailed Nov. 28, 2007 (12 pages).
Imperial Toy, LLC, PCT International Preliminary Report and Written Opinion for PCT Appln No. PCT/US2007/016479 mailed Feb. 5, 2009 (7 pages),

* cited by examiner

*Primary Examiner* — Tramar Harper
(74) *Attorney, Agent, or Firm* — Blakely, Sokoloff, Taylor & Zafman, LLP

(57) ABSTRACT

A punch toy including an animal shaped body. The animal shaped body includes legs, a head portion having a mouth, a tail portion and a tube portion connected to an opening of the mouth portion. The animal shaped body is expandable and the tube portion is stretchable.

11 Claims, 4 Drawing Sheets

ANIMAL SHAPED PUNCH TOY

BACKGROUND

1. Field

The embodiments relate to inflatable toys, and more particularly to animal shaped inflatable punch toys.

2. Description of the Related Art

There are many punch ball toys on the market today that typically include an opening for air to enter (e.g., a person blows/forces air into the opening) and a large rubber band gripping portion. These punch ball toys operate by a person blowing up the ball portion, holding the band portion with one hand and punching the ball over and over. These punch ball toys, however, have the same ball shape. While the aforementioned toys are entertaining, there is always room in the market for new toys.

SUMMARY

One embodiment includes an animal shaped punching toy. The toy has an expandable body portion having a head portion. A graspable tail portion is connected to the body portion. A tube portion is connected to an opening in the head portion. The tube portion operates to allow entry of forced air into the body portion.

Another embodiment includes an animal shaped punch toy having a body portion, a head portion and a tail portion. The punch toy is expandable. When air is forced through a tube portion into the head portion, the body portion expands.

And yet another embodiment includes a punch toy having an animal shaped body. The animal shaped body including legs, a head portion having a mouth, a tail portion, and a tube portion connected to an opening of the mouth portion. The animal shaped body is expandable and the tube portion is stretchable.

BRIEF DESCRIPTION OF THE DRAWINGS

The embodiments are illustrated by way of example, and not by way of limitation, in the figures of the accompanying drawings and in which like reference numerals refer to similar elements and in which.

DETAILED DESCRIPTION OF THE INVENTION

The invention generally relates to inflatable punch toys. Referring to the figures, exemplary embodiments of the invention will now be described. The exemplary embodiments are provided to illustrate the invention and should not be construed as limiting the scope of the invention.

Figure 1:
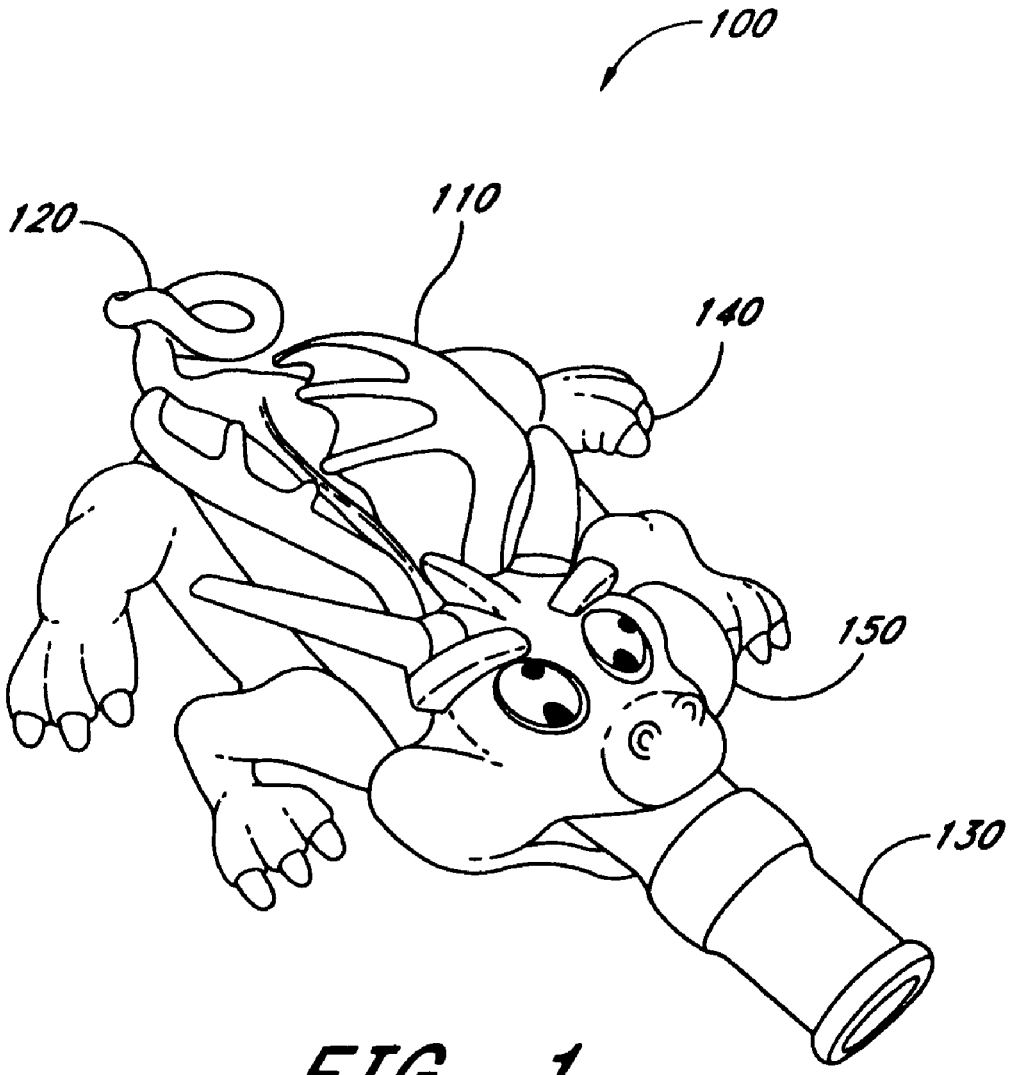
FIG. 1 illustrates an embodiment of a punch toy in a deflated state.

FIG. 1 illustrates an embodiment of a punch (or punching) toy 100. Punch toy 100 is illustrated as a dragon shaped toy, but one should note that other embodiments have different shapes and sizes, such as other amphibians, mammals, people, dinosaurs, birds, fish, etc. In one embodiment toy 100 is made of an elastic material, such as rubber, elastomer, elastomeric gel, elastic polymer, etc. The elastic material is tear resistant.

In one embodiment punch toy 100 includes a body portion 110, tail portion 120, head portion 150 and leg portions 140. In one another embodiment punch toy 100 has an outer wall that varies in thickness around punch toy 100. In this embodiment, the variation in thickness of the outer wall contributes to varying expandability of the outer wall.

Tail 120 is stretchable and forms a loop. The formed loop allows a person to grasp the tail around the loop or placing a finger through the loop. Head portion 150 has a mouth that has an opening leading to a cavity inside body portion 110. Tube 130 is connected to the opening and allows the passage of air into the cavity portion of the body. In one embodiment, body portion 110, tail portion 120, tube portion 130, legs 140 and head portion 150 are formed from a mold and form an integrated punch toy 100.

Figure 2:
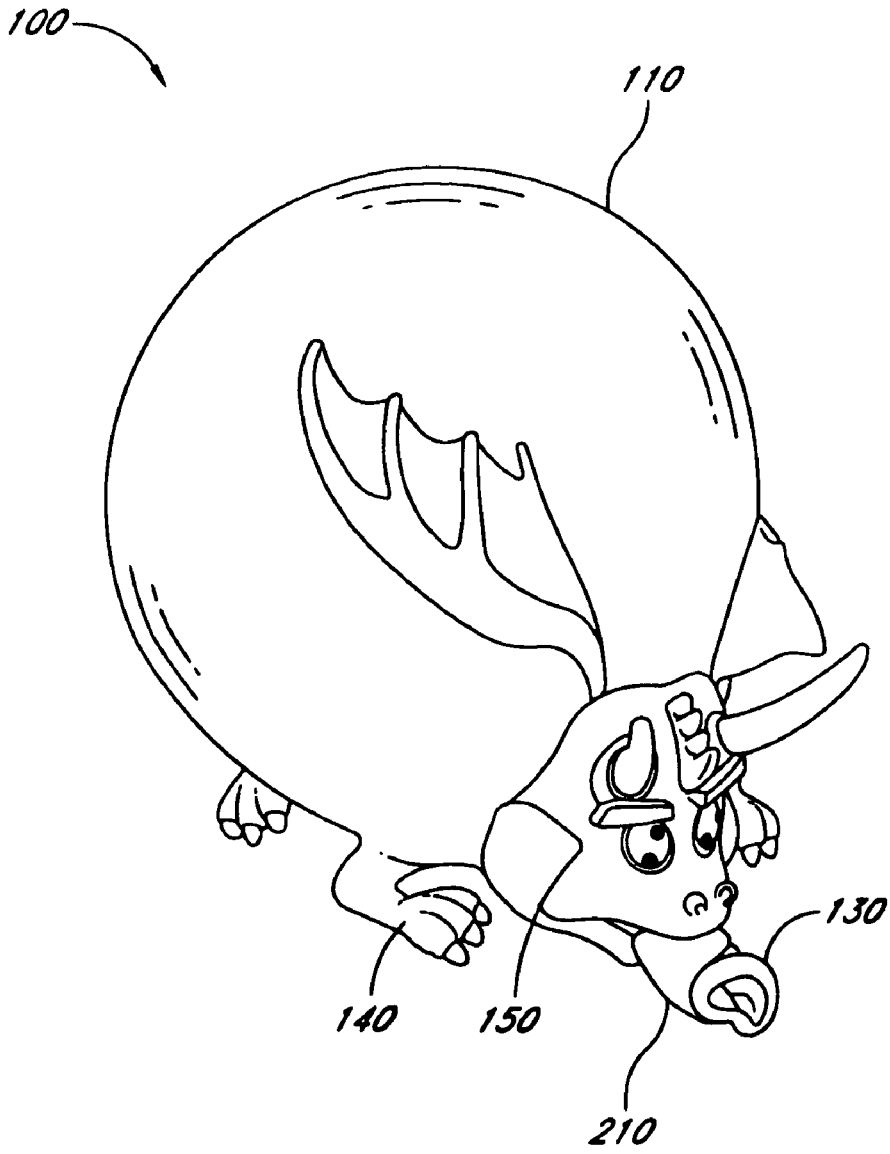
FIG. 2 illustrates the embodiment illustrated in FIG. 1 in an expanded state.

FIG. 2 illustrates punch toy 100 in an inflated state. As illustrated, air is forced into toy 100 through tube portion 130 into body portion 110 similarly as a person would blow up a balloon. As illustrated, only the body portion 110 of punch toy 100 inflates while legs 140 and head 150 do not expand when air is forced into the inner chamber. In this embodiment, due to the variation of thickness of the outer wall of punch toy 100, the portion that is thinner stretches out before the thicker portion. In this embodiment, the addition of air to the cavity of body portion 110 can have varying effect on the inflated shape of punch toy 100. This leads to entertaining distortions of punch toy 100 and the body portion 110 resembles a pseudo ball shape for a portion of the body portion 110. In one embodiment, the amount of air added into the cavity can vary causing the size of the inflated punch toy 100 to also vary. In one embodiment, appendages of punch toy 100 (e.g., legs 140, head portion 150, and tail portion 120, etc.) and an opening in the mouth retain their original shape when punch toy 100 is inflated. In another embodiment, one or more of these appendages is part of chamber and expand when air is forced into the cavity of body portion 110.

In one embodiment, in order for body portion 110 to retain air forced into the cavity of body portion 110, tube 130 is tied into a knot 210. While tube 130 has a thickness thicker than a standard blow up balloon, tube 130 is stretchable and when stretched can easily be tied into a knot. When knot 130 is untied, the trapped air escapes and punch toy 100 returns to its deflated state, where punch toy 100 can be played with by a person as an animal toy instead of a punch toy.

In another embodiment, punch toy 100 includes a valve disposed within tube portion 130. In this embodiment, the valve prevents air from escaping body portion 110. In one embodiment, the valve is a one way valve with an air release mechanism. Typical valves in devices (e.g., swimming pool float valves, air mattress type valves, ball type valves, etc.) that are inflated with air can be used.

In another embodiment, the punch toy 100 has a sound generation device disposed inside of tube 130. When punch toy 100 is deflated, the air forced out of the cavity in body portion 100 passes through the sound generation device to create amusing sounds. In one embodiment, the sound generation device is just an extra flap of material. In another embodiment, the sound generation device is a type of whistle.

In one embodiment, a battery and lights with a motion switch is encased in head portion 150. In this embodiment, when punch toy 100 is punched, lights shine through eyes in the head portion 150. Typical lights and motion sense or motion switch devices known by those in the art may be used in this embodiment. In one embodiment, a light display circuit is connected to the lights. In this embodiment, different display of lights are possible, such as blinking, randomly blinking, one eye blinking then the other eye blinking, both blinking together, etc.

Figure 3:
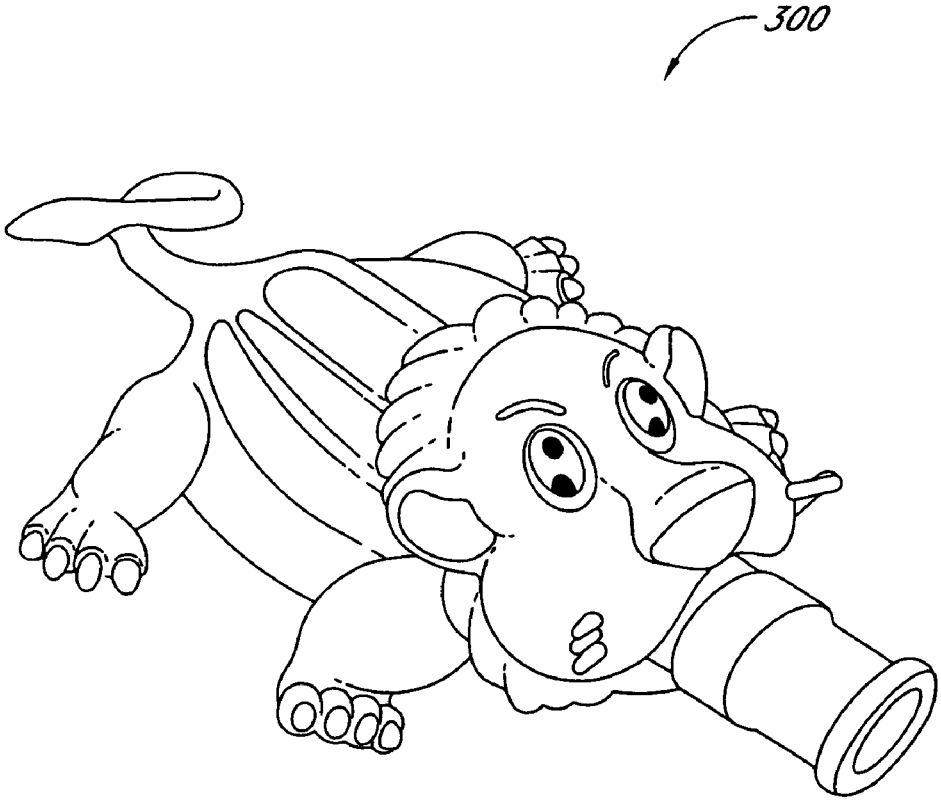
FIG. 3 illustrates another embodiment of a punch toy in a deflated state.

FIG. 3 illustrates punch toy 300 for an example of another shape for punch toy 100. In this embodiment, punch toy 300 is illustrated in a normal or deflated state. As illustrated, punch toy 500 has a lion shape.

Figure 4:
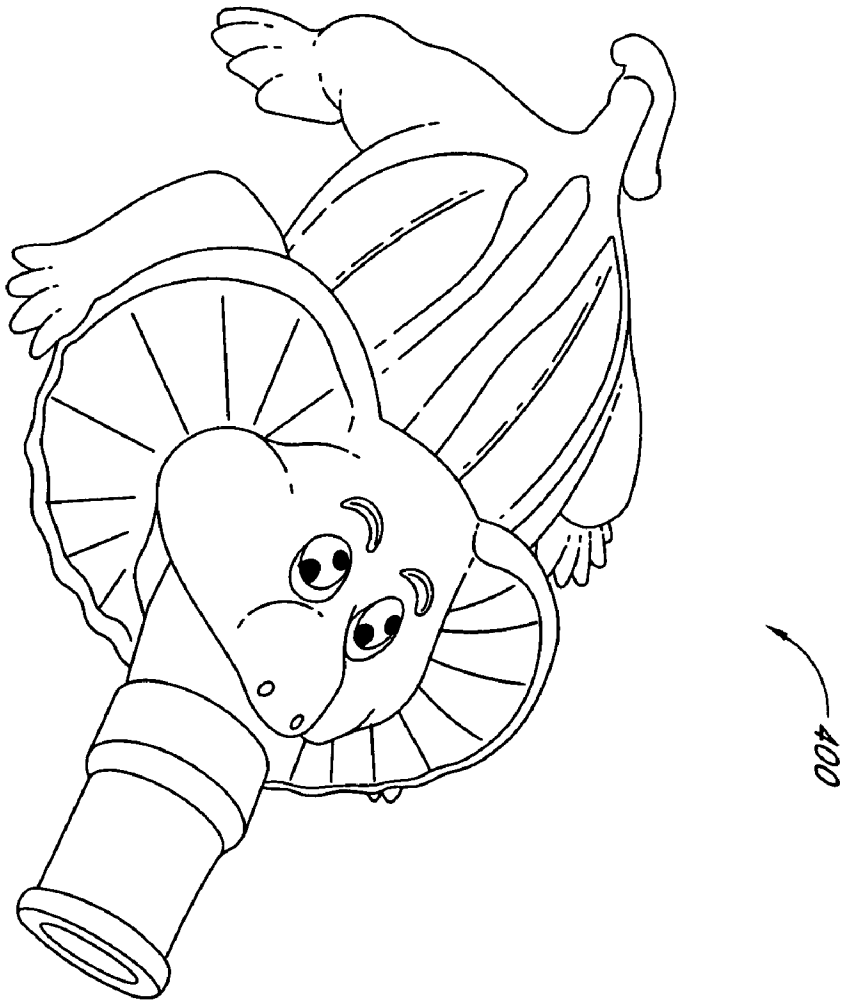
FIG. 4 illustrates yet another embodiment in a deflated state.

FIG. 4 illustrates punch toy 400 for an example of another shape for punch toy 100. In this embodiment, punch toy 400 is illustrated in a normal or deflated state. As illustrated, punch toy 400 has an elephant shape. In this embodiment, tube portion 130 appears to be the elephant's trunk.

With the tube portion 130, punch toy embodiments provide many inflation/deflation cycles by tying and untying tube portion 130 in a knot 210. Since various amount of air can be forced into the above-mentioned embodiments, many different shapes and sizes are possible, which leads to less boredom and different types of play. The punch toy embodiments are strong enough not to "pop" when a person is punching it in an inflated state. By inserting a finger through tail portion 120, a person can form a fist (or turn palm up to hit the punch toy with the open hand) and punch at the punch toy embodiments as long as they want. When the person punches a punch toy embodiment, the punch toy embodiment is forced away from the person's hand. Tail portion 120 stretches (i.e., lengthens). When tail portion 120 returns to its original shape it rebounds to force the punch toy to move back towards the person's hand or fist. The person can remove the knot and play with the punch toy in a deflated state.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A punching toy, comprising:

an elastomeric outer wall integrally forming an expandable body portion, a head portion, a tail portion and a tube portion coupled to the head portion;

a light emitting device coupled to the head portion to emit light from the head portion; and a motion sensing device coupled to the light emitting device, and wherein the tail portion comprises a closed loop sized to fit around a user's finger and configured to stretch from a first original length to a second longer length and rebound from the second length to the first original length during a punching operation and the tube portion comprises an opening to allow entry of forced air into the body portion.

2. The punching toy of claim 1, wherein the elastomeric outer wall expands from an original shape to an inflated shape when air is forced into the tube portion and reforms back to the original shape when the air is released.

3. The punching toy of claim 2, wherein the tube portion blocks air from escaping the body portion when tied in a knot.

4. The punching toy of claim 2, the tube portion having a valve, wherein the valve prevents air from escaping the body portion.

5. The punching toy of claim 1, wherein a size of the body portion is variable when expanded based on an amount of forced air retained.

6. The punching toy of claim 1, the body portion having at least two sets of legs.

7. The punching toy of claim 1, wherein the expandable body portion is configured to be expanded in a similar manner to a balloon when air is forced through the tube portion.

8. A method comprising:

inflating a toy having an elastomeric outer wall integrally forming a body portion, a head portion having a mouth and a tail portion from a first original configuration to a second expanded configuration wherein in the expanded configuration the body portion expands while the head portion, the mouth and the tail portion retain their original shape when air is forced therein, wherein a light emitting device is coupled to the head portion to emit light from the head portion and a motion sensing device is coupled to the light emitting device;

punching the toy, wherein punching comprises inserting a person's finger through a closed loop formed by the tail portion and forcing the body portion of the toy away from the person's hand while the finger remains within the closed loop; and wherein upon the release of air from the toy, the toy returns back to the first original configuration.

9. The method of claim 8, wherein the toy further comprises a tube portion coupled to the mouth of the head portion, wherein the tube portion operates to allow entry of forced air into the body portion.

10. The method of claim 9, wherein the tube portion is stretchable.

11. The method of claim 9, wherein the tube portion comprises a valve and the valve prevents air from escaping the body portion.

* * * * *